US008176798B2

(12) United States Patent
Ashrafzadeh et al.

(10) Patent No.: US 8,176,798 B2
(45) Date of Patent: May 15, 2012

(54) METHOD AND APPARATUS FOR DETERMINING LAUNDRY LOAD

(75) Inventors: Farhad Ashrafzadeh, Stevensville, MI (US); Kurt J. Mitts, Pontiac, MI (US); Richard A. Sunshine, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 238 days.

(21) Appl. No.: 12/499,963

(22) Filed: Jul. 9, 2009

(65) Prior Publication Data

US 2011/0005339 A1 Jan. 13, 2011

(51) Int. Cl.
*G01L 3/02* (2006.01)

(52) U.S. Cl. ..... 73/862.192

(58) Field of Classification Search ..... 73/862.192; 8/159

See application file for complete search history.

(56) References Cited

U.S. PATENT DOCUMENTS

| | | | | |
|---|---|---|---|---|
| 4,607,408 | A | 8/1986 | Didier et al. | |
| 4,741,182 | A | 5/1988 | Didier et al. | |
| 5,623,189 | A * | 4/1997 | Hemmer | 318/432 |
| 6,495,980 | B2 * | 12/2002 | Cho et al. | 318/400.02 |
| 7,017,217 | B2 | 3/2006 | Johanski et al. | |
| 7,299,515 | B2 | 11/2007 | Oh et al. | |
| 7,530,133 | B2 * | 5/2009 | Mitts | 8/159 |
| 7,735,173 | B2 * | 6/2010 | Kwon et al. | 8/159 |
| 2005/0284192 | A1 | 12/2005 | Altinier et al. | |
| 2006/0207299 | A1 | 9/2006 | Okazaki et al. | |
| 2006/0242768 | A1 | 11/2006 | Zhang et al. | |
| 2006/0265897 | A1 | 11/2006 | Jeong et al. | |
| 2007/0193310 | A1 | 8/2007 | Penteado et al. | |

FOREIGN PATENT DOCUMENTS

| | | | |
|---|---|---|---|
| DE | 4431846 | A1 | 3/1996 |
| DE | 19857903 | A1 | 6/1999 |
| EP | 0159202 | A1 | 1/1985 |
| EP | 1290259 | B1 | 3/2003 |
| EP | 1647625 | A2 | 4/2006 |
| JP | 11319367 | A | 11/1999 |

* cited by examiner

*Primary Examiner* — Lisa Caputo
*Assistant Examiner* — Octavia Davis-Hollington
(74) *Attorney, Agent, or Firm* — Clifton G. Green; McGarry Bair PC

(57) ABSTRACT

A method and apparatus for operating a laundry treating appliance that has a rotating treating chamber, which is rotatable about a rotation axis by a motor operably coupled to the rotating treating chamber, with the operation of the motor being controlled by an underdamped control scheme to determine a laundry load size.

31 Claims, 8 Drawing Sheets

METHOD AND APPARATUS FOR DETERMINING LAUNDRY LOAD

BACKGROUND OF THE INVENTION

In contemporary laundry treating appliances that treat laundry by the implementation of a treating cycle of operation, process settings for an operation cycle of a laundry treating appliance may depend on the size of a laundry load. In some laundry treating appliances, the user manually inputs a qualitative laundry load size (extra-small, small, medium, large, extra-large, etc.) through a user interface. In other treating appliances, the treating appliance automatically determines the laundry load size because, for example, manual input may be perceived as inconvenient to the user and may result in inaccurate laundry load size determination due to the subjective nature of the estimation.

In treating appliances having a drum defining the treating chamber and a motor for rotating the drum, a parameter of the motor, such as torque, may be indicative of a quantitative size, such as mass or weight, of the laundry, which may then be quantified. Historically, the motors have been controlled by a critically damped motor controller to ensure that the speed and movement of the drum responds appropriately accordingly to the implemented treating cycle of operation to achieve the desired treatment and care of the laundry.

SUMMARY OF THE INVENTION

A method and apparatus for operating a laundry treating appliance by applying an underdamped control scheme to a motor driving a drum of the laundry treating appliance, determining a parameter indicative of the torque of the motor, and then determining a laundry load size based on the parameter.

DESCRIPTION OF EMBODIMENTS OF THE INVENTION

Figure 1:
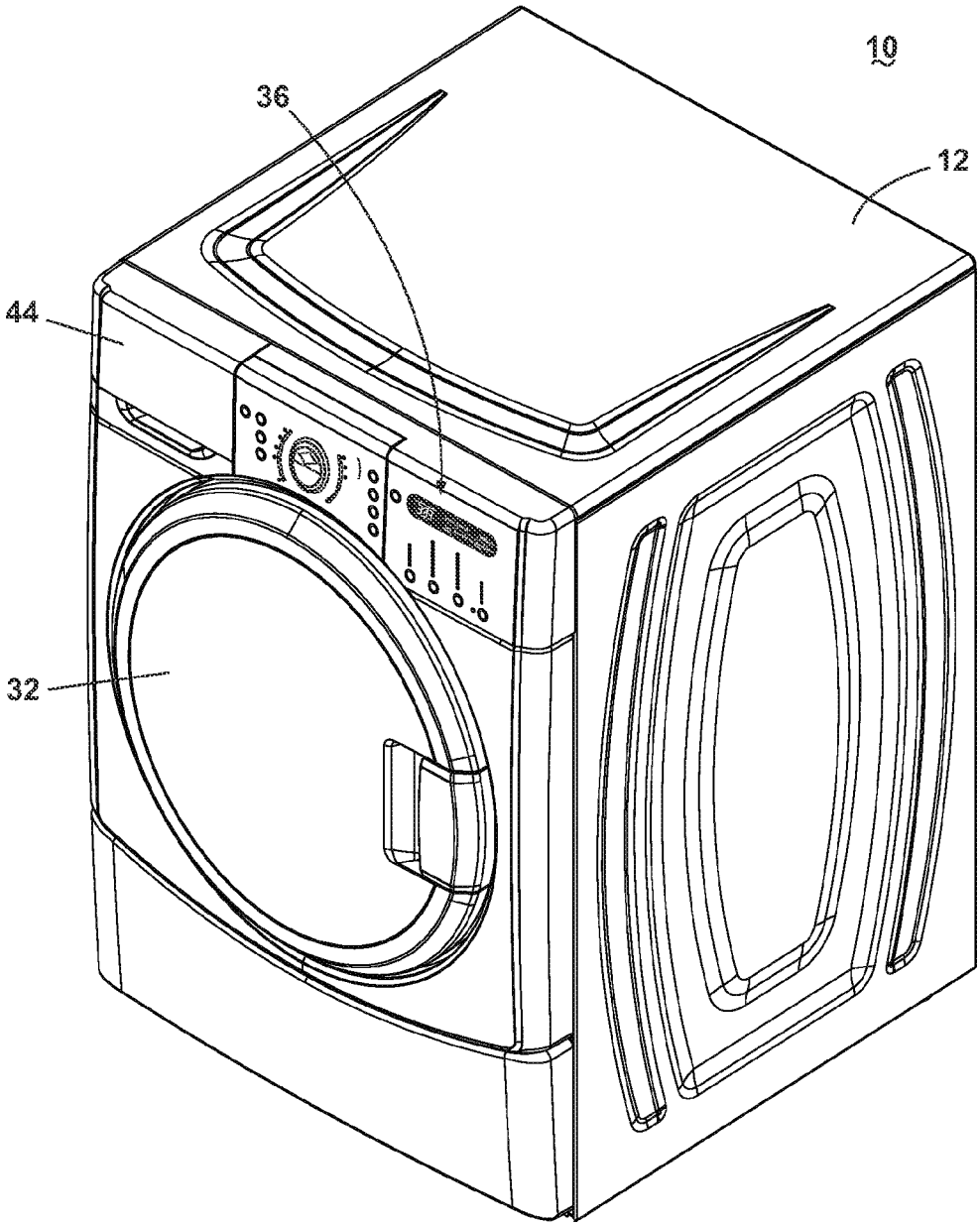
FIG. 1 is a perspective view of a laundry treating appliance in the form of a washing machine according to one embodiment of the invention.

Referring now to the figures, FIG. 1 is a perspective view of a laundry treating appliance in the form of a washing machine

10 according to a first embodiment. The washing machine 10 of the illustrated embodiment may include a cabinet 12 with a user interface 36 that may include one or more knobs, switches, displays, and the like for communicating with the user, such as to receive input and provide output.

The washing machine 10 is described and shown for illustrative purposes and is not intended to be limiting. Other laundry treating appliances than the washing machine 10 may be used. The laundry treating appliance may be any machine that treats fabrics, and examples of the laundry treating appliances may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine.

For illustrative purposes, embodiments of the invention will be described with respect to a washing machine with the fabric being a laundry load, with it being understood that the invention may be adapted for use with other types of laundry treating appliances for treating fabric.

Figure 2:
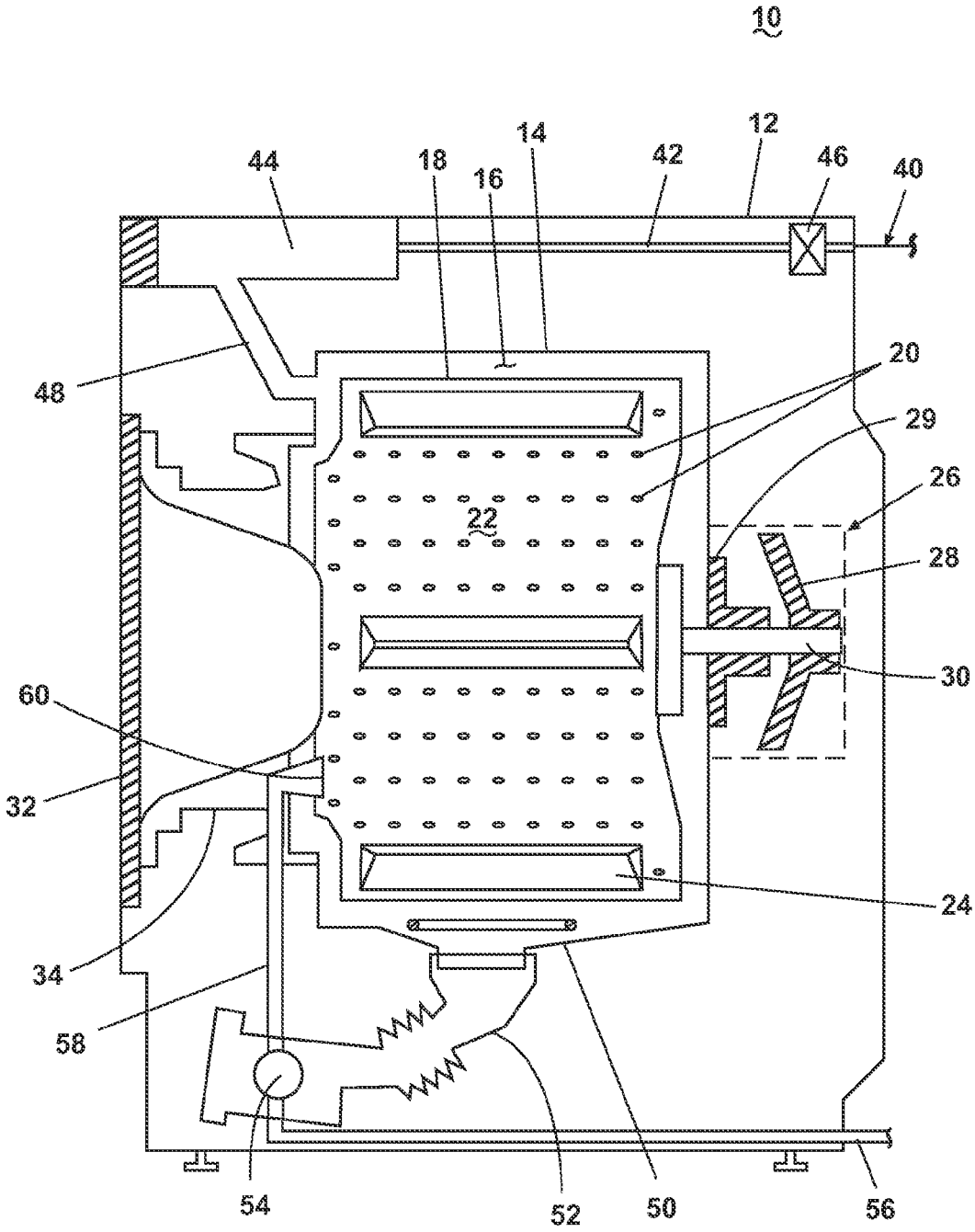
FIG. 2 is a schematic view of the washing machine of FIG. 1 according to a second embodiment of the invention.

FIG. 2 provides a schematic view of the washing machine 10 of FIG. 1 according to a second embodiment. The cabinet 12 of the illustrated washing machine 10 may house a stationary tub 14, which defines an interior chamber 16. A rotatable drum 18 may be mounted within the interior chamber 16 of the tub 14 and may include a plurality of perforations 20, such that liquid may flow between the tub 14 and the drum 18 through the perforations 20. The drum 18 defines a laundry treatment chamber 22 sized to hold a laundry load, which may have one fabric item or a plurality of fabric items. The drum 18 may further include a plurality of baffles 24 disposed on an inner surface of the drum 18 to lift the laundry load contained in the laundry treatment chamber 22 while the drum 18 rotates. A motor 26 may be a direct drive motor, having a rotor 28 and a stator 29, and configured to rotate the drum 18 via a drive shaft 30. Motors, such as a brushless permanent magnet (BPM) motor, an induction motor or a permanent split capacitor (PSC) motor may be used. Alternately, the motor 26 may be indirectly coupled with the drive shaft 30, as is known in the art. Both the tub 14 and the drum 18 may be selectively closed by a door 32. A bellows 34 couples an open face of the tub 14 with the cabinet 12, and the door 32 seals against the bellows 34 when the door 32 closes the tub 14.

While the illustrated washing machine 10 includes both the tub 14 and the drum 18, with the drum 18 defining the laundry treatment chamber 22, it is within the scope of the invention for the laundry treating appliance to include only one receptacle, with the receptacle defining the laundry treatment chamber for receiving the laundry load to be treated.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. In some vertical axis washing machines, the drum rotates about a vertical axis generally perpendicular to a surface that supports the washing machine. However, the rotational axis need not be perfectly vertical or perpendicular to the surface. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be perfectly horizontal or parallel to the surface. The drum can rotate about an axis inclined relative to the horizontal axis, with fifteen degrees of inclination being one example of inclination.

Vertical axis and horizontal axis machines can sometimes be differentiated by the manner in which they impart mechanical energy to the laundry load. In vertical axis machines, a fabric moving element moves within the drum to impart mechanical energy directly to the laundry load or indirectly through wash liquid in the drum. In horizontal axis machines, mechanical energy is typically imparted to the laundry load by tumbling the laundry load resulting from rotating the drum. The tumbling involves repeated lifting and dropping of the fabric items in the laundry load. The illustrated exemplary washing machine of FIGS. 1 and 2 is a horizontal axis washing machine, although the disclosed invention is applicable for the vertical axis machine, as well as other laundry treating appliances.

With continued reference to FIG. 2, the motor 26 may rotate the drum 18 at various speeds in either rotational direction. Depending on the physical characteristics of the washing machine 10, such as the size of the drum 18, and of the laundry load, the rotation of the drum 18 may result in various types of laundry load movement inside the drum 18. For example, the laundry load may undergo at least one of tumbling, rolling (also called balling), sliding, satellizing (also called plastering), and combinations thereof.

The washing machine 10 of FIG. 2 may further include a liquid supply and recirculation system. Liquid, such as water, may be supplied to the washing machine 10 from a water supply 40, such as a household water supply. A supply conduit 42 may fluidly couple the water supply 40 to a detergent dispenser 44. An inlet valve 46 may control flow of the liquid from the water supply 40 and through the supply conduit 42 to the detergent dispenser 44. A liquid conduit 48 may fluidly couple the detergent dispenser 44 with the tub 14. The liquid conduit 48 may couple with the tub 14 at any suitable location on the tub 14 and is shown as being coupled to a front wall of the tub 14 in FIG. 2 for exemplary purposes. The liquid that flows from the detergent dispenser 44 through the liquid conduit 48 to the tub 14 typically enters a space between the tub 14 and the drum 18 and may flow by gravity to a sump 50 formed in part by a lower portion of the tub 14. The sump 50 may also be formed by a sump conduit 52 that may fluidly couple the lower portion of the tub 14 to a pump 54. The pump 54 may direct fluid to a drain conduit 56, which may drain the liquid from the washing machine 10, or to a recirculation conduit 58, which may terminate at a recirculation inlet 60. The recirculation inlet 60 may direct the liquid from the recirculation conduit 58 into the drum 18. The recirculation inlet 60 may introduce the liquid into the drum 18 in any suitable manner, such as by spraying, dripping, or providing a steady flow of the liquid.

The liquid supply and recirculation system may further include one or more devices for heating the liquid; exemplary devices include sump heaters and steam generators. Additionally, the liquid supply and recirculation system may differ from the configuration shown in FIG. 2, such as by inclusion of other valves, conduits, wash aid dispensers, sensors, such as water level sensors and temperature sensors, and the like, to control the flow of liquid through the washing machine 10 and for the introduction of more than one type of detergent/wash aid. Further, the liquid supply and recirculation system need not include the recirculation portion of the system or may include other types of recirculation systems.

In case of a dryer, an air flow system (not shown) may be used, having a blower to first draw air across a heating element and into the drum, through a lint filter, and finally out through an exhaust conduit that is connected to an exhaust vent system leading out of the house.

The washing machine 10 may perform one or more manual or automatic operation cycles, and a common operation cycle includes a wash phase, a rinse phase, and a spin extraction phase. Other phases for operation cycles include, but are not limited to, intermediate extraction phases, such as between the wash and rinse phases, and a pre-wash phase preceding the wash phase, and some operation cycles include only a select one or more of these exemplary phases. Regardless of the phases employed in the operation cycle, the methods described below may be used for determining a size of the laundry load before or during any phase of the cycle or operation. The size may be a qualitative size, such as, for example, small, medium, or large, or a quantitative size, such as the load mass.

Figure 3:
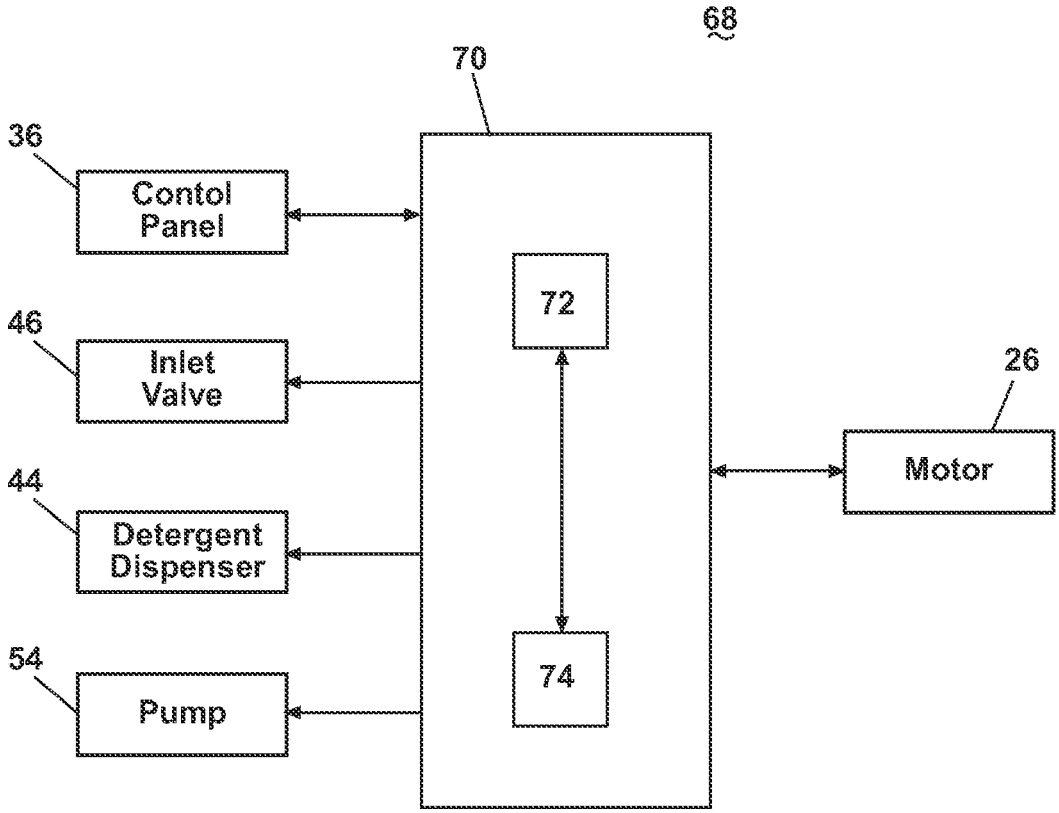
FIG. 3 is a schematic view of a control system according to a third embodiment of the invention for the washing machine of FIGS. 1 and 2.

Referring now to FIG. 3, which is a schematic view of an control system 68 for use in a laundry treating appliance, such as the washing machine 10, and representing a third embodiment of the invention. The control system 68 may include a controller 70 coupled to various working components of the washing machine 10, such as the pump 54, the motor 26, the inlet valve 46, and the detergent dispenser 44, to control the operation of the washing machine 10. The controller 70 may receive data from one or more of the working components and may provide commands, which can be based on the received data, to one or more of the working components to execute a desired operation of the washing machine 10. The commands may be data and/or an electrical signal without data, for example. The control panel 36 may be coupled to the controller 70 and may provide for input/output to/from the controller 70. In other words, the control panel 36 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 70. The specific type of controller is not germane to the invention. The controller 70 may be a combination of a main machine controller 72 and a motor controller 74 within one physical location or a practical implementation may require their physical separation. The motor controller 74 may be configured to control the motor 26 and physically located on the motor and electrically coupled to the controller, and the main machine controller may be configured to control other working components of the washing machine 10. It is contemplated that the controller 70 is a microprocessor-based controller that implements control software, which may comprise one or more software applications, and sends/receives one or more electrical signals to/from each of the various working components to affect the control software. Examples of possible controllers are but not limited to: proportional control (P), proportional integral control (PI), and proportional derivative control (PD), or a combination thereof, a proportional integral derivative control (PID control), may be used to control the various components.

Before specific embodiments of the methods according to the invention are presented, a description of theory behind the methods may be constructive to a complete understanding. The proposed technique of the present invention is based on using a closed-loop speed control system in which the motor torque or a parameter indicative of the motor torque may be available. The parameter indicative of the motor torque may be motor voltage or current. The control system may therefore be any system in which the motor torque may be directly sensed or estimated by a suitable system parameter indicative of torque. Such a system, for example, may be a BPM drive, which is based on a brushless permanent magnet (BPM) motor, or a CIM system, based on cascade induction motor, with a vector control. If a DuoSPIM (duo single phase induction motor) or CIM with a conventional control technique (V/F=constant) is used, then an advanced algorithm may be used for torque estimation.

Figure 4:
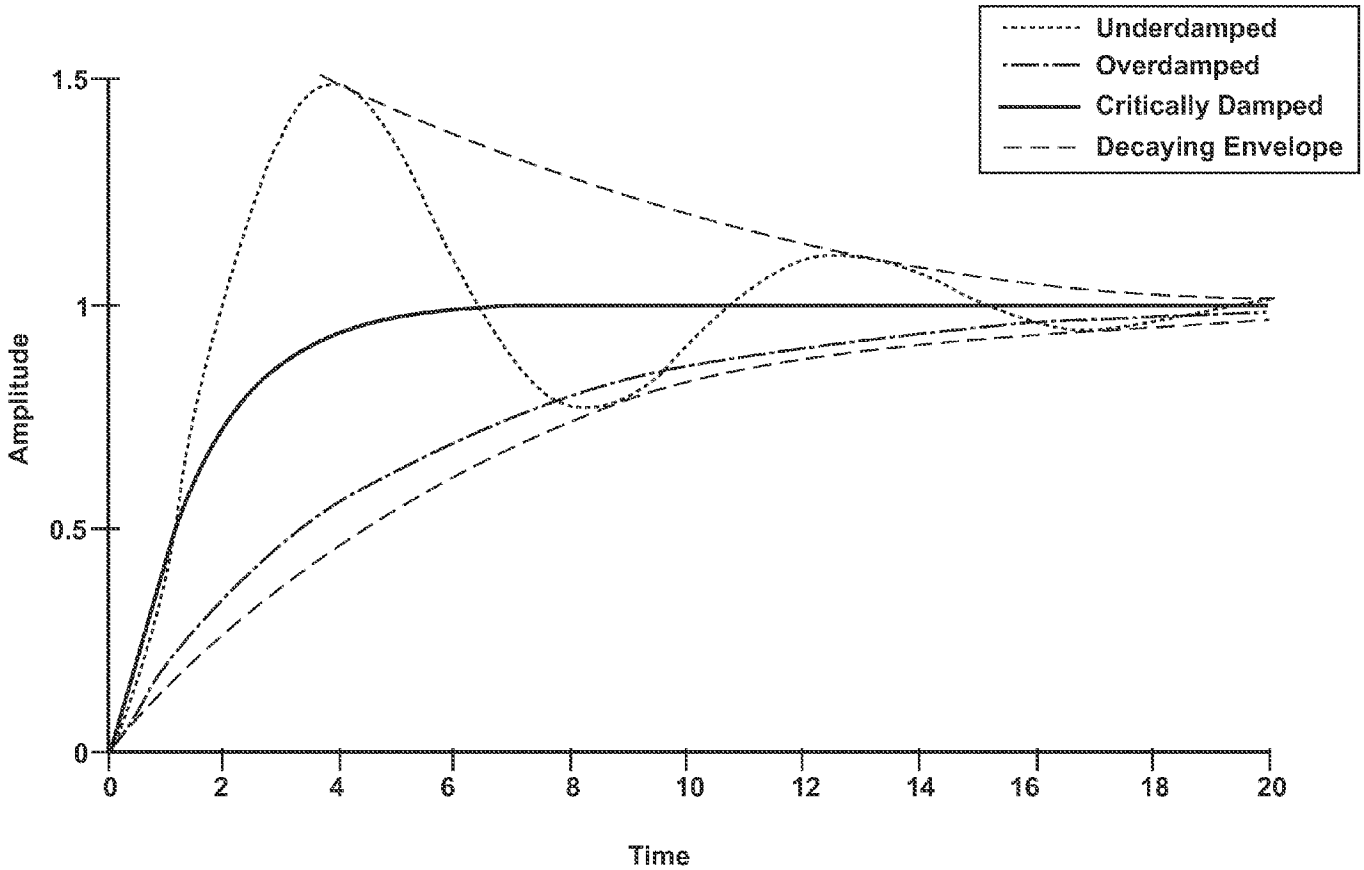
FIG. 4 is a step response of a closed loop control scheme in time domain for an underdamped, overdamped, and critically damped control systems.

FIG. 4 shows a graphical representation of an ideal step response of closed loop system in time domain for underdamped, critically damped and overdamped control systems with respect to a set reference point or steady-state value of 1.0. In the case of a laundry treating appliance with a rotating drum, the set reference point will normally be a set speed for the rotational speed of the drum. Therefore, the reference point of 1.0 for FIG. 4 may be thought of as a speed for discussion purposes.

It can be seen that the underdamped response has a transient speed that oscillates within a decaying envelope relative to the set speed, and has a damping ratio less than 1. The overdamped response does not oscillate about the set speed, but takes longer to reach the set speed than the critically damped response. The overdamped response has a damping ratio of greater than 1. The critically damped response does not oscillate about the set speed and reaches the set speed the fastest. The critically damped response has a damping ratio of 1. Thus, it can be noted, that both the critically damped and overdamped control settings demonstrate non-oscillating responses relative to the set speed.

The proposed technique uses an underdamped control system (oscillatory) to enhances the resolution of the data provided for the torque or indicative parameter, which may be used to determine the size of the laundry load, regardless of the unit of measure be it qualitative units such as, mass, weight, inertia, or quantative units such as extra small, small, medium, large, and extra large. The enhanced resolution results in the underdamped system making the motor a much better sensor as far as torque and torque-indicative parameters are concerned, with the sensor providing a greater resolution for the amount of the laundry.

The underdamped response may be achieved by reducing a damping factor and changing an integral coefficient in a PI controller, or by selecting appropriate proportional and integral coefficients. Such an oscillatory behavior will show up only in the motor torque and will not be much noticeable in the drum speed. An exemplary horizontal axis washing machine with the BPM drive was selected for the demonstrated in FIG. 4 graphs.

It should be noted that while the underdamped response results in the motor providing greater resolution and more utility as a torque sensor, the underdamped response is less desirable for actually controlling the rotational speed of the drum because the drum takes longer to reach the set speed, which can have many undesirable consequences. For example, if the drum set speed is to be just below or at a satellizing speed, it is possible for the transient drum speed to oscillate between satellizing and non-satellizing speeds. Therefore, it is contemplated that once the laundry amount is determined, the underdamped control scheme may be replaced with either a critically damped or overdamped control scheme. In fact the control schemes may be replaced as needed to complete a particular treating cycle.

Figure 5:
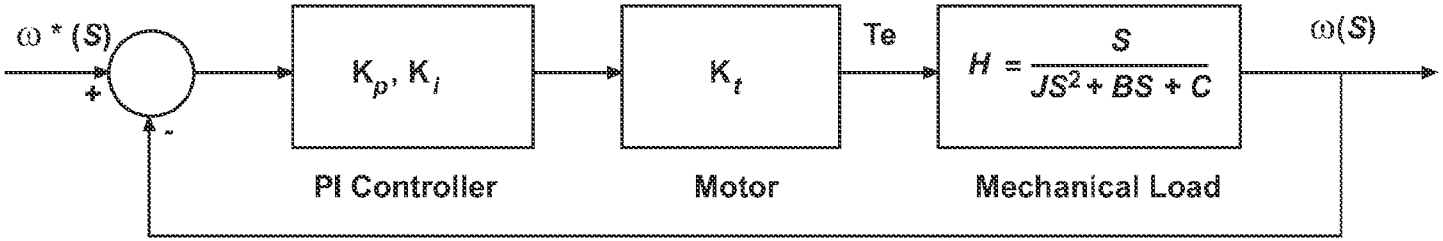
FIG. 5 is a block diagram of a closed loop control scheme according to a fourth embodiment of the invention.

FIG. 5 illustrates a block diagram of a closed-loop control system according to a fourth embodiment of the invention. The illustrated control system has the following components: a set speed $\omega^*(s)$ on the input (i.e. the desired drum speed), a PI controller, a motor, a mechanical load and an actual drum speed $\omega(s)$ on the output. Where, Te is a motor torque, $K_p$ and $K_i$ are proportional and integral gains/coefficients of the controller correspondingly, which may be selected to obtain the desired system response, such as the underdamped response.

Figure 6:
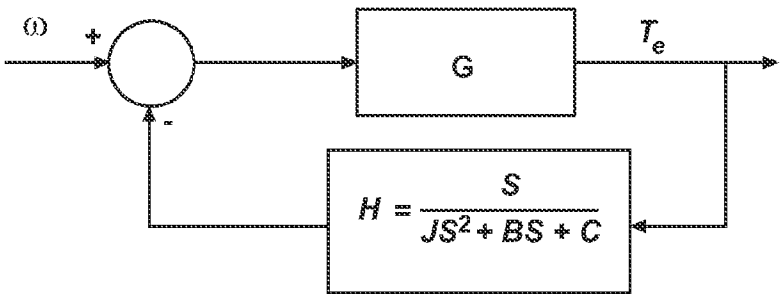
FIG. 6 is the closed loop control system of FIG. 5 in rearranged and simplified form.

FIG. 6 is the closed loop control system of FIG. 5 in a rearranged and simplified form, where the input is still the speed reference but the output is a motor torque. The transfer function form input $\omega^*$ to the output Te is as follows:

$$T_e = \frac{G}{1+GH}\omega^* \tag{1}$$

The dynamic model of the motor mechanical load is as follows:

$$T_e(t)=J\dot{\omega})(t)+B\omega(t)+C \tag{2}$$

Where Te(t) and $\omega(t)$ are motor torque and speed a an instance of time t. J, B and C are coefficients as follows: J—total moment of inertia, B—total viscous friction and C—total coulomb friction.

By integrating both sides of Equation (2) from start to the specific instance time of t, we will have:

$$\int_0^{t_1} T_e(t)dt = J\omega(t_1) + B\int_0^{t_1} \omega(t)dt + Ct_1 \tag{3}$$

If the drum is accelerated with a fixed ramp of $\alpha$, than the speed becomes:

$$\omega(t)=\alpha t \tag{4}$$

Substituting Equation (4) into Equation (3) yields:

$$\int_0^{t_1} T_e(t)dt = Jat_1 + \frac{1}{2}at_1^2B + Ct_1 \tag{5}$$

The correlation between the total inertia and the torque integral is:

$$J = \frac{1}{at_1}\left(\int_0^{t_1} T_e(t)dt\right) - \frac{1}{2}t_1B - \frac{1}{a}C \tag{6}$$

According to the Equation (6) to maximize sensitivity of the system inertia to the torque integral and at the same time to minimize the effect of both viscous and coulomb frictions (due to aging and manufacturing variations), the acceleration should be increased and the observation time t should be reduced. In other words, a suitable fast acceleration will nominalize the torque associated with the system friction. Thus, the invention concept may be more robust if the acceleration is chosen to be very fast and the time t (at which the value of integral is calculated) is chosen to be small. The magnitude of the acceleration and the duration of the observation time necessary to nominalize torque associated with the system friction will typically be machine-platform dependent and can be determined by suitable testing for each machine platform. Some non-limiting examples of the suitable fast acceleration are: a substantially step acceleration, acceleration of at least at about 80% or greater of maximum acceleration for the motor, and acceleration at a rate such that the motor torque is proportional to the load-related torque.

Figure 7:
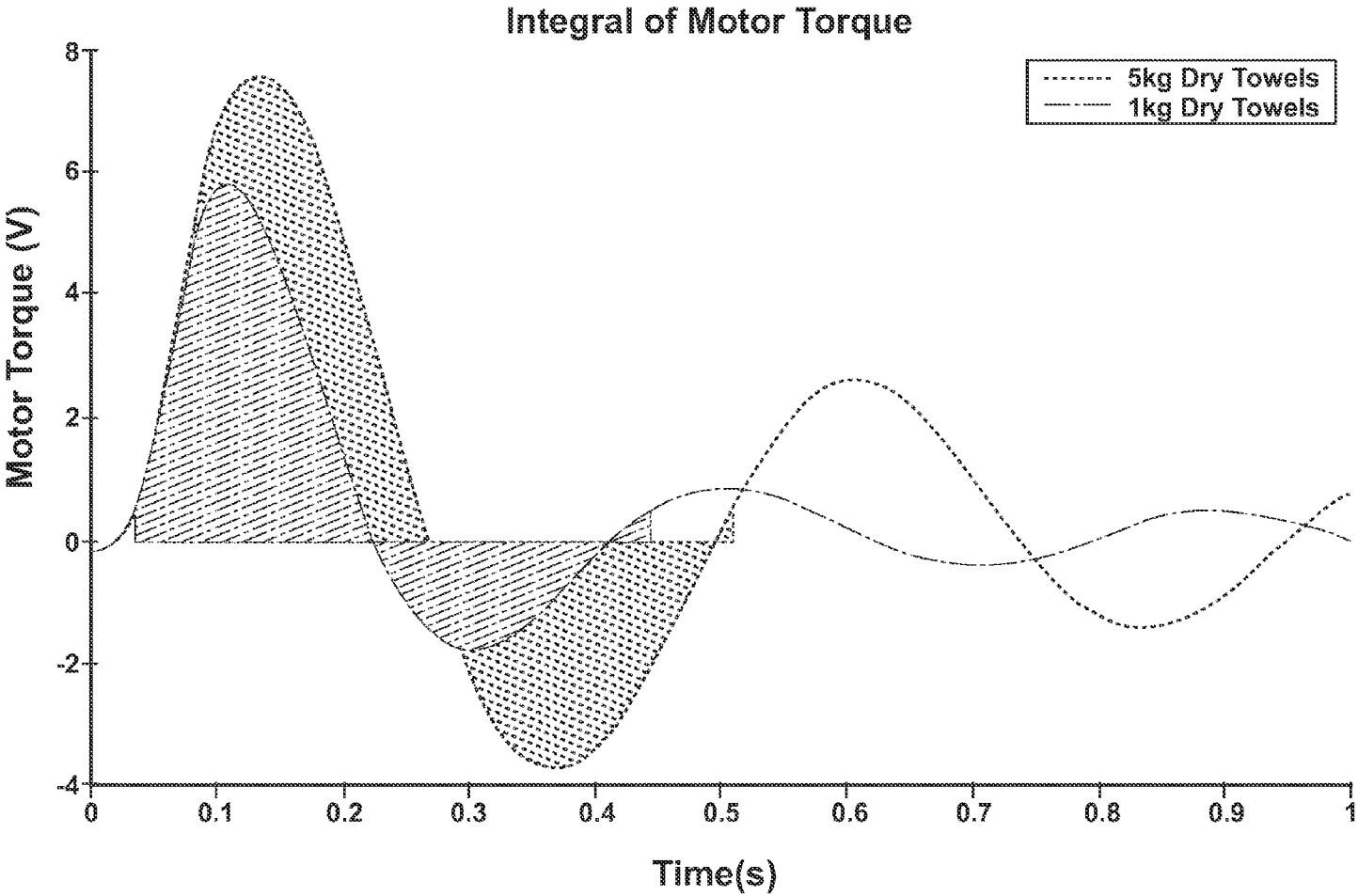
FIG. 7 is a graph of a motor torque during a fast acceleration phase for dry load sizes of 1 kg and 5 kg when the control system of FIG. 3 applies an underdamped closed loop control scheme of FIGS. 5 and 6.

Referring now to FIG. 7, it is shown the motor torque during a fast acceleration phase for dry load sizes of 1 kg and 5 kg using the closed-loop control scheme of FIGS. 5 and 6. For the demonstrated graph, the damping ratio coefficient $\xi$ and the integral coefficient $K_i$ were chosen to be $\xi=700$ and $K_i=11$, collectively referred to as the motor controller parameters. It can be clearly noticed, that a profile of the torque integral significantly differs for the different load sizes. Particularly, both motor torque amplitude (i.e. motor torque peaks) and motor torque damping period of oscillations are smaller for the smaller load size. Thus, either of these values may be used for the load size estimation. However, more accurate load size estimation may be made based on motor torque integral itself (i.e. net area bounded by the torque function) as demonstrated in the FIG. 7 by hatching.

Figure 8:
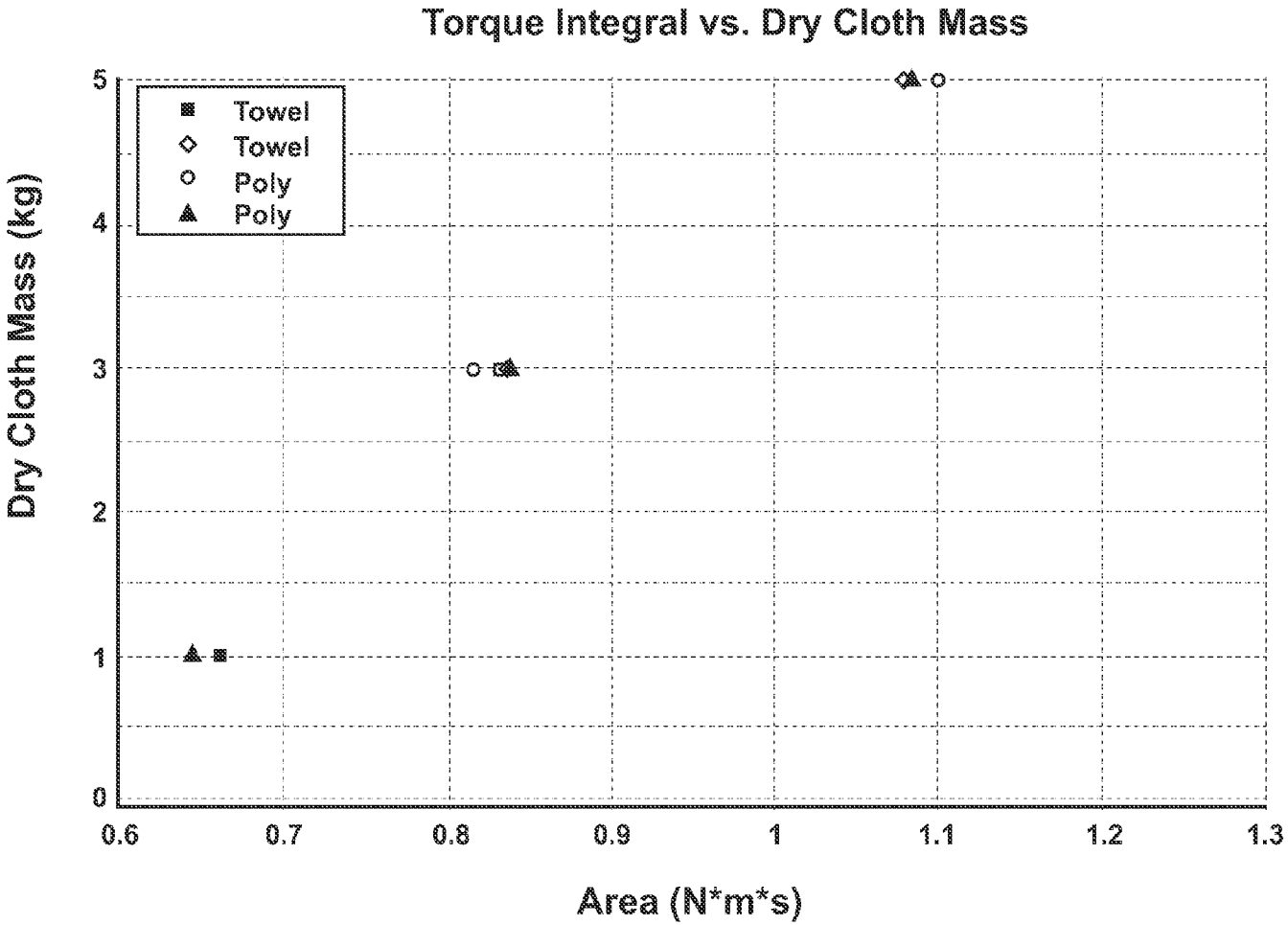
FIG. 8 is a correlation graph of loads of different sizes and a torque integral resulting from the application of the underdamped closed loop control scheme of FIGS. 5 and 6.

FIG. 8 illustrates that accuracy of the correlation between the torque integral and different loads for different type loads. FIG. 8 shows correlation between towel and polyester loads of three different sizes (1 kg, 3 kg and 5 kg) and the torque integral. The measurements for each load size and type of laundry load were taken more than once to demonstrate a precision and repeatability of the proposed approach. Each load is identified with a different symbol. It can be seen, that the torque integral increases proportionally to increase of the dry mass of the laundry load. The torque integral values for repeated measurements of the towel and polyester loads of the same mass are shown to be grouped relatively close to each other. Thus, the present invention provides a good resolution for the load size estimation in a range between 1 Kg to 5 Kg regardless of a laundry type. The invention also enables the load size estimation for the ranges below 1 Kg and above 5 Kg. A look-up table of corresponding quantitative load size and integral values of the motor torque may be used for the load size estimation.

A good approximation describing the correlation of FIG. 8 may be give by a following equation:

$$y=-6.4x^2+20.3x-9.5 \quad (7)$$

The estimation of the load size described above may be made for a wet or dry load. The torque signature of the wet load will have more noises due to additional water and its variable behavior during the step response; however those noises may be filtered by an algorithm.

It may be more beneficial to estimate the dry mass as the wet mass alone does not give an information regarding laundry type. If the dry mass is known, then laundry type may be identified and, therefore, right operating parameters (i.e. water temperature, speed profile for tumbling, and spin, etc.) may be selected for all phases (wash, rinse, spin extraction, etc) of the cycle of operation.

As described above, the control system may operate according to the underdamped control scheme by selecting appropriate damping factor and/or other controller coefficients. The microcontroller may determine the desired value of controller parameter(s) before each phase or cycle of operation. Those parameters may change as the cycle proceeds to the next phase. The values for a given washer may be identified and programmed into the microcomputer by a manufacture. The main controller 72 may write the pre-specified values for coefficients into the motor controller 74 as soon as the sensing has started. Ranges and limits for each coefficient may be selected such that the variation in drum speed is not much noticeable by a user. The ranges also depend on a capacity (i.e. maximum load size) and a type (for example, horizontal or vertical axis) of the washing machine. For example, the integral coefficient may be selected to be between 5 and 11, although other ranges may be applicable depending on the specifics of a laundry treating appliance.

Figure 9:
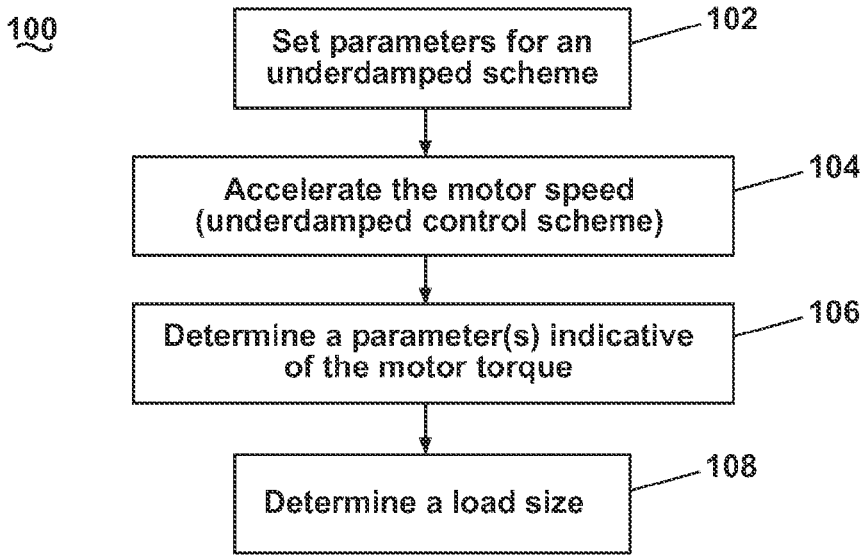
FIG. 9 is a flow chart of a method according to a fifth embodiment of the invention.

FIG. 9 provides a flow chart of one embodiment of a method 100 that employs the above theory for determination of the load size and may be implemented by the washing machine 10 described above. The sequence of steps depicted is for illustrative purposes only and is not meant to limit the method 100 in any way as it is understood that the steps may proceed in a different logical order, additional or intervening steps may be included, or described steps may be divided into multiple steps, without detracting from the invention. The method 100 may be incorporated into an operation cycle of the washing machine 10, such as during a pre-wash or wash phase, or may be performed independently from an operation cycle.

The method 100 may begin by setting one or more motor parameters, such as the damping ratio, integral and/or proportional coefficients of the underdamped scheme to be used by the motor controller 74 at 102. The setting one or more parameters for the underdamped scheme at 102 may be optional but is included in this embodiment for illustrative purposes. The method 100 may further continue with accelerating the motor speed according to the underdamped control scheme to accelerate the drum 18. The rotating of the drum 18 may occur in either rotational direction for a predetermined time. The predetermined time may be any time sufficient for load size estimating. The motor may be accelerated at about 80% or greater of maximum acceleration for the motor 26, approximately a step acceleration, or at a rate such that the motor torque is proportional to a load-related torque. Determining the at least one parameter indicative of the torque of the motor 26 may occur at 106 during the motor acceleration 104. The at least one parameter of 106 may be acquired for any suitable time period, and an exemplary time period may be a substantially small period of 30-40 seconds to minimize any potential clothes damage. The determining at least one parameter indicative of the torque of the motor at 106 may include summing the parameter during at least a portion of the time the motor is accelerated at 104. The summing may be a running total of the at least one parameter and the running total may be integral of the motor torque. The at least one parameter may be one of: motor voltage, motor current, motor torque, or a combination thereof. The determined the load size may be a qualitative or quantitative, and may include looking up a corresponding load size for the integral of the torque from a predetermined table of corresponding load size and integral values.

Figure 10:
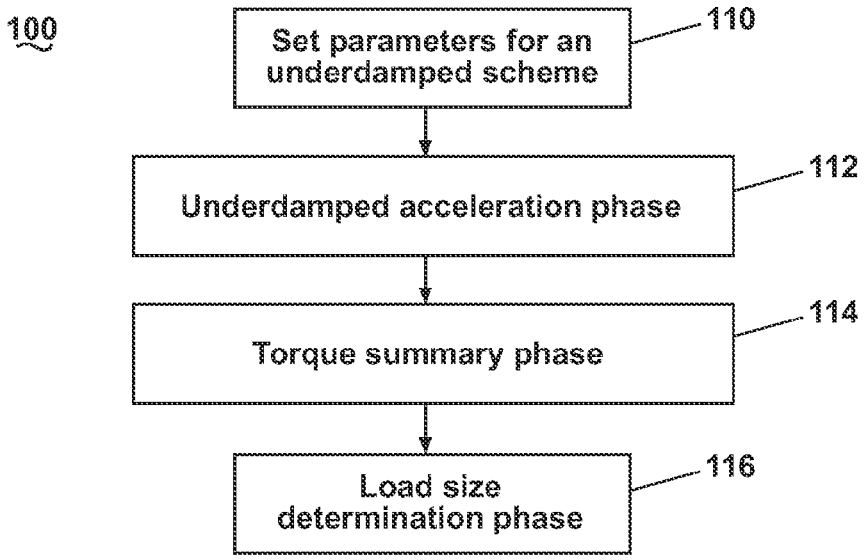
FIG. 10 is a flow chart of a method according to a sixth embodiment of the invention.

FIG. 10 provides a flow chart of another embodiment of a method 100 similar to the first embodiment. This embodiment may also optionally begin by setting one or more motor parameters at 110 for an underdamped scheme to be used by the motor controller 74. The method 100 may further continue with an underdamped acceleration phase 110, accelerating the motor speed according to the underdamped control scheme. Similarly, the rotating of the drum 18 may occur in either rotational direction for a predetermined time and the acceleration may be at least one of: at about 80% or greater of maximum acceleration for the motor 26, approximately a step acceleration, or at a rate such that the motor torque is proportional to a load-related torque. A torque summing phase 114, when a motor parameter indicative of the torque is summed, may be during at least a portion of the underdamped acceleration phase 112. Lastly, a load size determination phase 116 may be performed to determine the load size from the summed motor parameter. The summed parameter may be an integral of the motor torque. As described above, the at least one parameter may be one of: motor voltage, motor current, motor torque, or a combination thereof; and the determined the load size may be a qualitative or quantitative, and may include looking up a corresponding load size for the integral of the torque.

The methods 100 may be used with any treating cycle of operation. They may be a stand-alone cycle that is run before the treating cycle of operation or incorporated into a treating cycle of operation. Thus, after the method 100 is completed, if desired, the motor parameters may be changed as need be to implement a non-underdamped control scheme for the treating cycle or the remainder of the treating cycle, as the case may be.

While the embodiments described above employ motor torque as the motor characteristic employed for determining the laundry load size, the underlying theory for determining the load size relies on the rotational speed of the laundry load, and the method 100 may be adapted for acquiring, sensing, etc. the rotational speed of the drum 18 in other manners. As an alternative, the motor active power can also be used for determining the load. Using various metric results in various resolutions in estimated laundry load size.

The embodiments of the method 100 have been described with respect to the washing machine 10 in FIG. 1, which is a horizontal axis washing machine. However, the method 100 may be adapted for use in other types of washing machines, including horizontal axis washing machines having a tilted drum and vertical axis washing machines, and other types of laundry treating appliances. While some commercially available horizontal axis washing machines have a drum angled at about fifteen degrees, the drum angle may be smaller or greater. The particular algorithms, such as the algorithm for underdamping the control scheme and for determining the parameter employed in the method 100, may need to be adapted to accommodate the drum angle because the drum angle may affect the manner in which the laundry load interacts with the drum.

Vertical axis washing machine with an impeller will have higher friction between clothes and impeller, so the selected controller coefficients should be modified for a desired accuracy of the loads size determination. In case of a vertical axis washing machine with an agitator, agitator vanes may play role of a spring action. That spring action may be modeled and the proposed model tuned appropriately. However, even without taking into account the effect of the vanes spring action, the proposed method may still be used to determined the load mass, perhaps with less resolution. Further, the method 100 may be adapted for use in other types of laundry treating appliances, including appliances that do not saturate the laundry, such as clothes dryers and laundry refreshing machines. Modifications to the algorithms may be necessary when employing the method 100 in these types of laundry treating appliances.

The embodiments of the method described herein for determination of laundry load size may be advantageous over the other methods for several reasons. The embodiments provide automatic laundry load size determination that employs existing components of the laundry treating appliance; the motor functions not only to rotate the drum but also works as a sensor that provides data for use in determining the laundry load size, thereby eliminating the cost of additional sensors and the like. Further, with the automatic determination of the laundry load size may be done in a relatively short time frame and may be more accurate than subjective input of a laundry load size by the user. Thus, the process settings for an operation cycle may be adaptive to a particular load size, which may improve the cycle optimization, an unbalance detection, energy and resource savings (e.g., the cycle may employ appropriate amounts of water, cycle lengths, rotational speeds, steam use in steam dispensing appliances, chemistry use in chemistry dispensing appliances, detergent use in automatic detergent dispensing appliances, etc.).

The methods of the present invention may determine the dry laundry load size. Determination of the dry laundry size is particularly beneficial, as they enable determination of other important parameters, such as a laundry type. Additionally, the underdamped control scheme used for determination of the laundry load size according to the present invention does not result in any additional fabric damage, contrary to some other convention methods.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of operating a laundry treating appliance having a rotatable drum defining a treating chamber, a motor driving the rotation of the drum, and a controller for controlling the operation of the motor according to a treating cycle of operation, the method comprising:

accelerating the motor speed to a set speed with an underdamped control scheme such that a transient speed of the drum oscillates within a decaying envelope relative to the set speed; and determining a parameter indicative of the torque of the motor while the motor is accelerated with the underdamped control scheme; and determining a load size based on the parameter.

2. The method of claim 1 wherein the drum is rotated about a horizontal axis of rotation.

3. The method of claim 1 wherein the motor is accelerated at about 80% of maximum acceleration for the motor.

4. The method of claim 1 wherein the motor is accelerated to approximate a step acceleration.

5. The method of claim 1 wherein the motor is accelerated at a rate such that the motor torque is proportional to a load-related torque.

6. The method of claim 5 wherein the parameter is the integral of torque of the motor during at least a portion of the time the motor is accelerated.

7. The method of claim 6 wherein the determining of the load size is a qualitative determination.

8. The method of claim 7 wherein the qualitative determination comprises looking up a corresponding qualitative load size for the integral of the torque from a predetermined table of corresponding quantitative load size and integral values.

9. The method of claim 1 wherein the parameter is summed during at least a portion of the time the motor is accelerated.

10. The method of claim 9 wherein the sum is a running total of the parameter.

11. The method of claim 10 wherein the sum is the integral of the torque.

12. The method of claim 1 wherein the parameter is one of: motor voltage, motor current, motor torque.

13. The method of claim 1 wherein a non-underdamped control scheme is used to control the motor after the determining of the load size.

14. The method of claim 13 wherein the non-underdamped control scheme is a critically damped control scheme.

15. A laundry treating appliance comprising:

a rotatable drum defining a treating chamber and rotating about a horizontal axis of rotation;

a motor operably coupled to the drum to rotate the drum; and a controller operably coupled to the motor and configured to control the operation of the motor according to a treating cycle of operation, with the controller further configured to accelerate the motor to a set speed with an underdamped control scheme such that a transient speed of the drum oscillates within a decaying envelope relative to the set speed, determine a parameter indicative of the torque of the motor during the acceleration, and determine a load size based on the parameter.

16. The laundry treating appliance of claim 15 wherein a non-underdamped control scheme is used to control the motor after the determining of the load size.

17. The laundry treating appliance of claim 15 wherein the motor is accelerated at a rate such that the motor torque is proportional to a load-related torque.

18. The laundry treating appliance of claim 17 wherein the parameter is the integral of torque of the motor during at least a portion of the time the motor is accelerated.

19. The laundry treating appliance of claim 18 wherein the controller is configured to determine a qualitative load size.

20. The laundry treating appliance of claim 19 wherein the controller is configured to look up a corresponding qualitative load size for the integral of the torque from a predetermined table of corresponding quantitative load size and integral values.

21. The laundry treating appliance of claim 15 wherein the motor is configured to accelerate the motor at no less than 80% of the max acceleration of the motor when determining the parameter indicative of torque.

22. A method for determining the load size of a laundry load of operating a laundry treating appliance having a rotatable drum defining a treating chamber for receiving the laundry load, a motor driving the rotation of the drum, and a controller for controlling the operation of the motor according to a treating cycle of operation, the method comprising:

an underdamped acceleration phase where the motor is accelerated with an underdamped control scheme such that a transient speed of the drum oscillates within a decaying envelope relative to a set speed;

a torque summing phase where a motor parameter indicative of the torque is summed during at least a portion of the underdamped acceleration phase; and a load size determination phase where the load size is determined from the summed motor parameter.

23. The method of claim 22 wherein the drum is rotated about a horizontal axis of rotation.

24. The method of claim 22 wherein the underdamped acceleration phase comprises at least one of:

accelerating the motor at least at 80% of maximum acceleration for the motor;

accelerating the motor to approximate a step acceleration; and accelerating the motor at a rate such that the motor torque is proportional to a load-related torque.

25. The method of claim 24 wherein the torque summing phase comprises determining an integral of torque of the motor during at least a portion of the time the motor is accelerated.

26. The method of claim 25 wherein the load size determination phase comprises determining a qualitative determination based on the torque integral.

27. The method of claim 26 wherein the qualitative determination comprises looking up a corresponding qualitative load size for the integral of the torque from a predetermined table of corresponding quantitative load size and integral values.

28. The method of claim 22 wherein the parameter is one of: motor voltage, motor current, motor torque.

29. The method of claim 22 wherein the load size determination phase comprises determining a qualitative load size.

30. The method of claim 29 wherein the qualitative determination comprises looking up a corresponding qualitative load size for determined parameter from a predetermined table of corresponding quantitative load size and determined parameter values.

31. The method of claim 22 wherein a non-underdamped control scheme is used to control the motor after the determination phase.

* * * * *